US006079935A

United States Patent [19]

Brunner et al.

[11] Patent Number: 6,079,935

[45] Date of Patent: Jun. 27, 2000

[54] FORKLIFT TRUCK

[75] Inventors: Norbert Brunner; Bernhard Götz; Rudolf Mundkowski; Wilhelm Spennemann, all of Aschaffenburg, Germany

[73] Assignee: Linde Aktiengesellschaft, Germany

[21] Appl. No.: 08/959,111

[22] Filed: Oct. 23, 1997

Related U.S. Application Data

[63] Continuation-in-part of application No. 08/543,792, Oct. 16, 1995, abandoned.

[30] Foreign Application Priority Data

Nov. 11, 1994 [DE] Germany ..... 44 40 399

[51] Int. Cl.[7] ..... B66F 9/06

[52] U.S. Cl. ..... 414/641; 414/673; 414/664; 414/668; 414/914; 414/917; 187/226; 180/24.02; 180/209; 180/210; 180/906

[58] Field of Search ..... 414/917, 914, 414/662, 663, 664, 668, 659, 661, 630, 631, 637, 628, 629, 546, 673, 641, 642; 254/10 R, 10 C; 187/222, 234, 237, 226; 180/210, 906, 24.02, 209; 280/638, 688, 149.2

[56] References Cited

U.S. PATENT DOCUMENTS

| | | | |
|---|---|---|---|
| 2,349,352 | 5/1944 | Johnson | 187/234 X |
| 2,724,521 | 11/1955 | Squires | 414/914 X |
| 2,810,489 | 10/1957 | Davies | 414/914 X |
| 2,855,119 | 10/1958 | Arnot | 187/226 X |
| 3,082,894 | 3/1963 | Gibson | 414/668 |
| 3,997,029 | 12/1976 | Evans | 414/914 X |
| 4,069,932 | 1/1978 | Stedman | 414/664 |
| 4,207,967 | 6/1980 | Stedman | 414/914 X |
| 4,266,808 | 5/1981 | Fassett | 414/914 X |

FOREIGN PATENT DOCUMENTS

| | | | |
|---|---|---|---|
| 1506744 | 12/1967 | France | 187/234 |
| 4016497 | 11/1991 | Germany | 414/914 |
| 862880 | 3/1961 | United Kingdom | 187/222 |

*Primary Examiner*—Frank E. Werner
*Attorney, Agent, or Firm*—Webb Ziesenheim Logsdon Orkin & Hanson, P.C.

[57] ABSTRACT

A forklift truck has a frame, a cab including a roof to protect the driver and a lift support structure connected to the frame. A load-carrying fork is mounted on the lift support structure for vertical movement and the lift support structure, the roof and the frame are all welded together to form a single load-bearing assembly.

21 Claims, 5 Drawing Sheets

FORKLIFT TRUCK

This application is a continuation-in-part of application Ser. No. 08/543,792 filed on Oct. 16, 1995, now abandoned.

BACKGROUND OF THE INVENTION

1. Field of the Invention

This invention relates generally to a forklift truck having a frame, a cab including a roof to protect the operator and an upwardly extending lift support structure to which a vertically movable load-carrying device is fastened.

2. Description of the Prior Art

Forklift trucks are industrial trucks whereby a load is carried outside of the truck wheel base. A vertically extending lift support structure which can be inclined around a horizontal transverse axis is fastened to a frame which consists of longitudinal beams and cross members in the vicinity of the floor of the cab. The cab can be opened or closed and includes a cover to protect the operator from falling objects. A counterweight is fastened to the rear of the frame which in many cases is a part of the frame such as a cross member. The frame is the load-bearing component of the forklift truck, to which all of the other components of the forklift truck are connected.

Forklift trucks are used as industrial trucks in many branches of industry. For example, the trucks are used in relatively narrow warehouse aisles where the space between the shelves is generally insufficient to accommodate a forklift truck with a counterweight thereon. For such an application, special industrial trucks, such as reach trucks, high-lift trucks with poles (with and without a man-carrying support structure) and high-lift trucks with seats and standard work stations are available. However, these industrial trucks are expensive, because of their special design and because they are not manufactured in large numbers.

SUMMARY OF THE INVENTION

An object of the invention is to create a forklift truck of the type described above which can be used in locations where only a limited amount of space is available such as in narrow aisles in warehouses and which can be manufactured economically.

The invention achieves these objects by connecting the lift support structure and the roof to the frame to form a single load-bearing assembly. This type of construction results in a relatively short industrial truck with very high rigidity. Because of its compact construction, such a forklift truck is optimally suited for use in warehouses having narrow aisles between adjacent rows of shelves, which eliminates the need for industrial trucks specially designed for such applications. It is thereby possible to reduce the variety of industrial trucks which must be produced.

In one embodiment of the invention which has high strength and is easy to manufacture, the lift support structure, the roof and the frame are welded to one another. A forklift truck manufactured in this manner has advantages over conventional forklift trucks as it is lighter in weight.

In another embodiment of the invention, the lift support structure has a stationary mast section which is connected to the roof and to the frame and an extendable mast section is located inside the stationary mast section for vertical movement relative thereto. A forklift truck according to this embodiment of the invention can lift a load to great heights.

It is also advantageous according to the invention if the load-carrying device is inclined so that loads can be easily picked up and put down.

Spaced wheels are mounted on the forward edge of the frame of the forklift truck close to the load-carrying device, and at least one rear wheel is mounted on the frame spaced from the load and from the spaced wheels in the longitudinal direction of the truck. A particularly compact design is achieved if the lift support structure is located between the spaced wheels which are close to the load-carrying device. The center of gravity of the load is placed as close as possible to the center of gravity of the truck, and the weight of the truck acts as a counterweight to the load which means that the size of an independent counterweight can be significantly reduced or, in some cases, eliminated. A forklift truck according to the invention is very stable when lifting loads to great heights. Since the load is located partially over the spaced wheels, the traction characteristics of a forklift truck according to the invention are improved. Moreover, a forklift truck according to the invention permits the width of the aisles between the shelves in a warehouse to be reduced so that more shelves can be provided in the same amount of space.

To place the spaced front wheels close to the load to be picked up, the load-carrying device, when it is lowered, is advantageously moved horizontally toward the load away from the spaced wheels. Electronic or hydraulic control and propulsion mechanisms can be used for this purpose. The horizontal movement of the load during the vertical movement of the load-carrying device can be carried out by the operator, in which case the load-carrying device, as it is lowered, is moved in front of the spaced wheels. If there is no space available for the horizontal movement of the load during stacking and unstacking operations, the automatic and/or prompted horizontal movement of the load-carrying device can be deactivated or disengaged.

In a further embodiment of the invention, when the load-carrying device is raised above the level of the spaced wheels, the spaced wheels are automatically moved forwardly toward the load. The resulting increase in the wheelbase of the truck increases the stability of the truck when the load is raised and improves traction characteristics. When the load-carrying device is fully lowered, the truck can drive directly up to the load. This embodiment also has the advantage that increased space is available for the power mechanism for moving the truck. It will be understood that the lifting height of the load-carrying device on the lift support structure is not affected.

In this embodiment, a positive movement, i.e., one prompted by the operator, is possible so that when the load-carrying device is raised above the spaced wheels, the spaced wheels can be moved forwardly toward the load in response to a command from the operator. In this embodiment, the automatic and/or prompted movement of the spaced wheels can also be deactivated or disengaged when appropriate.

A forklift truck according to the invention is battery powered and electrically operated. The forklift truck can be operated by an operator in a standing position, in which case the battery is located next to the operator's station. In spite of its short construction, such a forklift truck provides a comfortable work space for the operator. The operator can access the cab quickly and easily because the distance between the cab floor and the travel surface is small.

The same advantages are also present in the embodiment of the invention wherein the forklift truck is battery powered and electrically operated by an operator in a seated position. In this embodiment, the battery is located underneath the operator's seat.

In both cases, at least one wheel at the rear of the forklift truck farther from the load is powered and can be steered.

A complete understanding of the invention will be obtained from the following description when taken in connection with the accompanying drawings wherein like reference characters identify like parts throughout.

DESCRIPTION OF THE PREFERRED EMBODIMENTS

Figure 1:
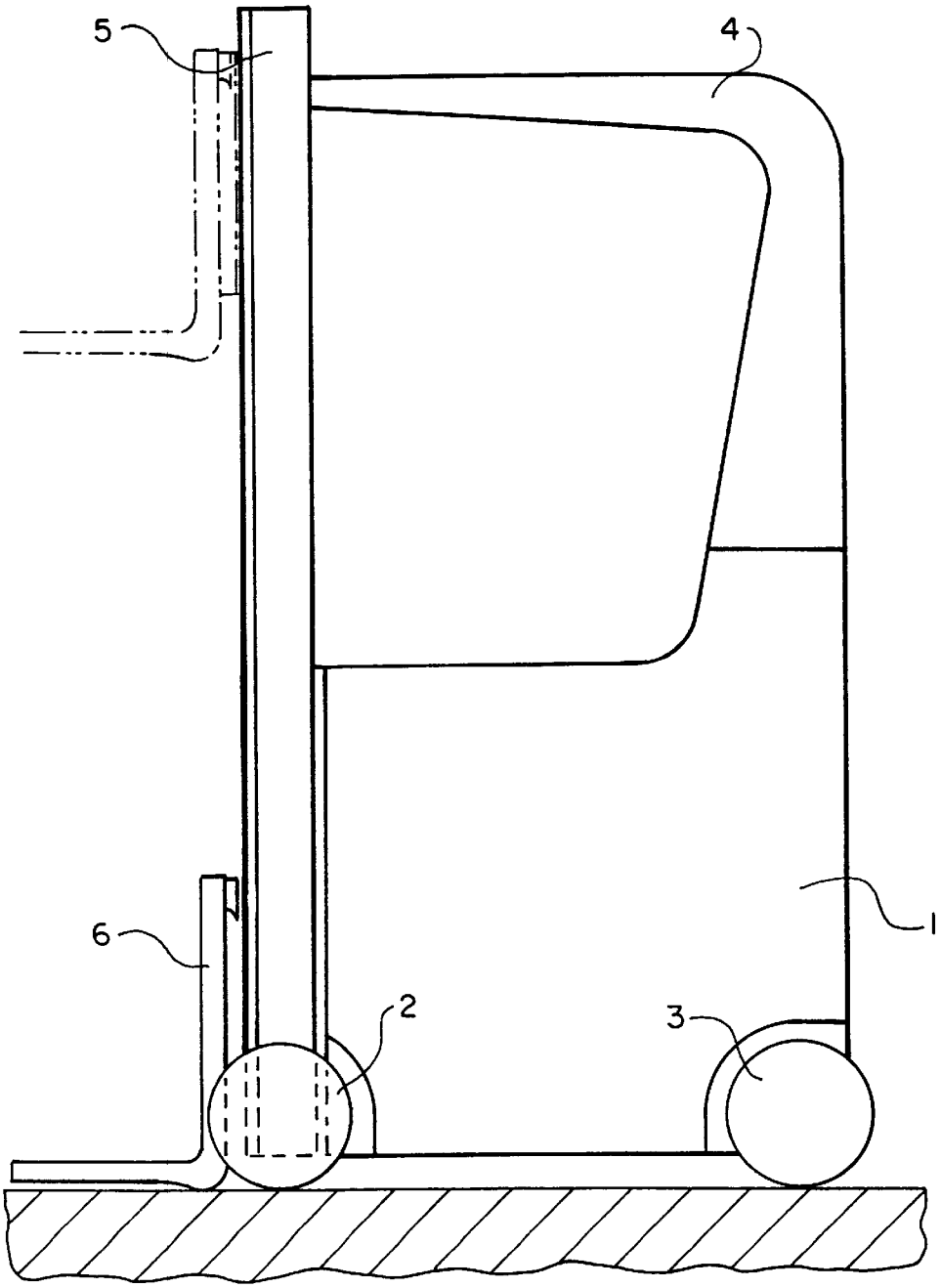
FIG. 1 is a side elevation of a forklift truck according to the invention.

Referring to FIG. 1 of the drawings, the forklift truck has a frame 1 with spaced front wheels 2 mounted thereon close to the load-carrying forks. Rear wheels 3 are mounted on the rear of the frame longitudinally spaced from the load-carrying forks. The forklift truck can have a single pivotally mounted rear wheel or two standard rear wheels. A cab roof 4 is welded to the frame 1 and extends over the operator to protect the operator from falling objects. A lift support structure or mast 5 is mounted on the frame adjacent to spaced front wheels 2. All of the components are connected to form a single, load-bearing, short forklift truck having great rigidity and a low weight.

A vertically movable load-carrying device 6 is fastened to the lift support structure 5 in the manner of the prior art. In the embodiments of the invention shown and described herein, the load-carrying device 6 is a well-known fork. To facilitate the stacking and unstacking of loads, it is possible to construct the load-carrying device 6 so that it can be inclined.

In one embodiment of the invention, the lift support structure 5 consists of two columns which are connected to one another by cross members to form a stationary mast section. When a greater lifting height is desired, at least one extendable mast section is located within the boundaries of the stationary mast section. The extendable mast section also consists of columns which are connected to one another by cross members.

Figure 2:
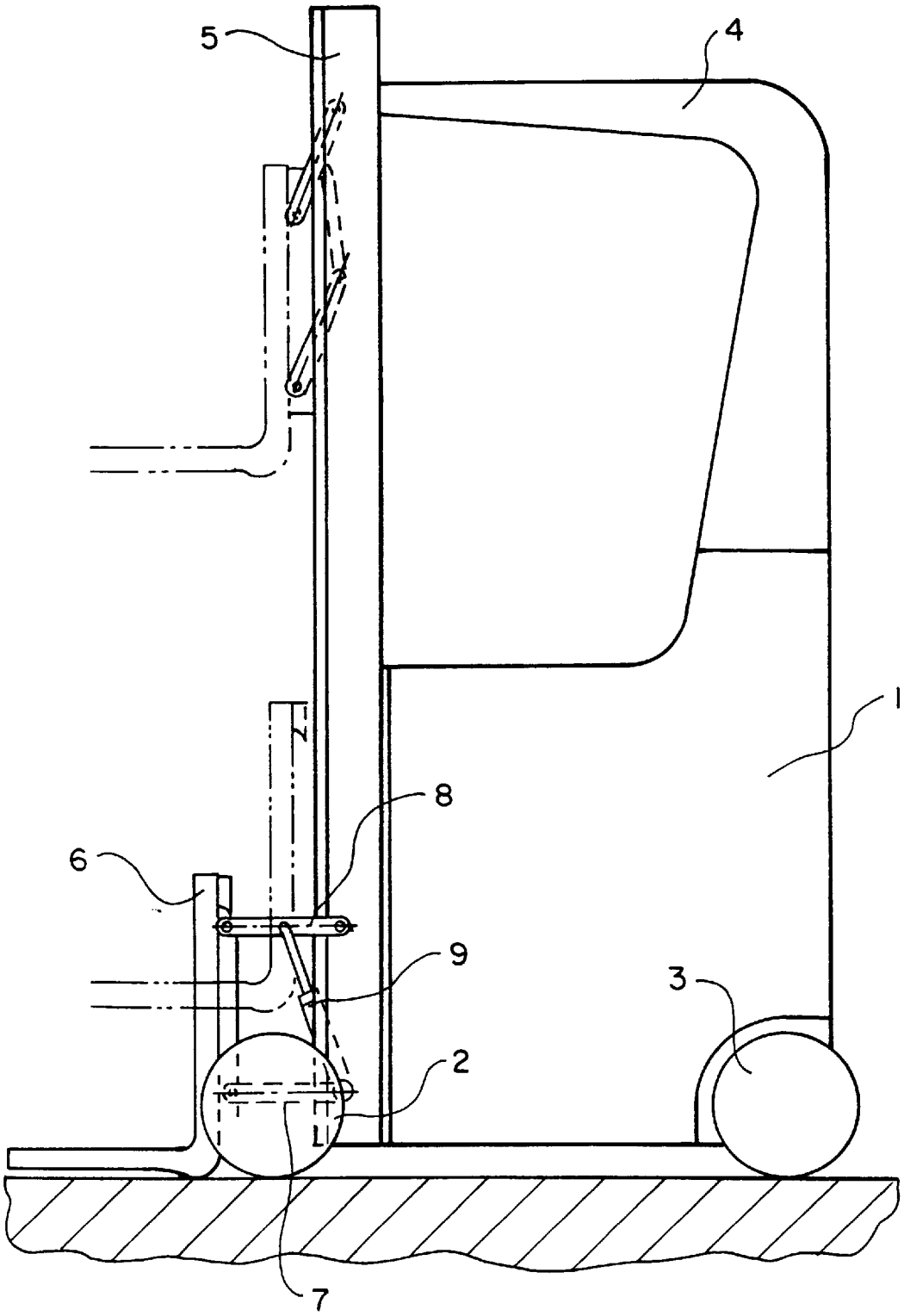
FIG. 2 is a side elevation of a second embodiment of a forklift truck according to the invention with a load advance mechanism.

FIG. 2 of the drawings shows an embodiment of a forklift truck wherein the lift support structure 5 is located longitudinally between the spaced front wheels 2 and the rear wheels 3. The greater part of each front wheel 2 is located forwardly of the lift support structure 5 so that the center of gravity of the load is located as close as is structurally possible to the center of gravity of the truck. The empty weight of the forklift truck according to the invention, which acts as a counterweight to the load, can therefore be relatively low. The forklift truck of the invention is very stable for lifting loads to great heights. Additionally, since the raised load is located partially over the wheels 2, the forklift truck has improved traction characteristics. As a result of this design, the width of the aisles between the shelves in a warehouse can be relatively narrow.

The load-carrying device 6 can be moved forwardly of the front wheels 2 to be closer to the load in order to absorb the load. This movement preferably occurs automatically when the load-carrying device 6 is lowered. When the load-carrying device 6 is raised from its lowest position, it is automatically moved rearwardly toward the lift support structure 5 to accomplish the advantages described above. The vehicle therefore travels with the load located over the spaced front wheels 2, which makes it possible for the vehicle to travel through narrow aisles.

In the embodiment of the invention shown in FIG. 2 of the drawings, the load-carrying device 6 is moved forwardly by a parallelogram arrangement consisting of arms 7 and 8, which are actuated by a hydraulic cylinder 9. Electronic or hydraulic control of the hydraulic cylinder can be used in this embodiment of the invention. The advance movement can also be positively initiated by means of multiple linkages.

If there is insufficient clearance available for the horizontal forward movement of the load-carrying device 6, the automatic and/or manually controlled movement of the load-carrying device 6 can be deactivated or disengaged.

Figure 3:
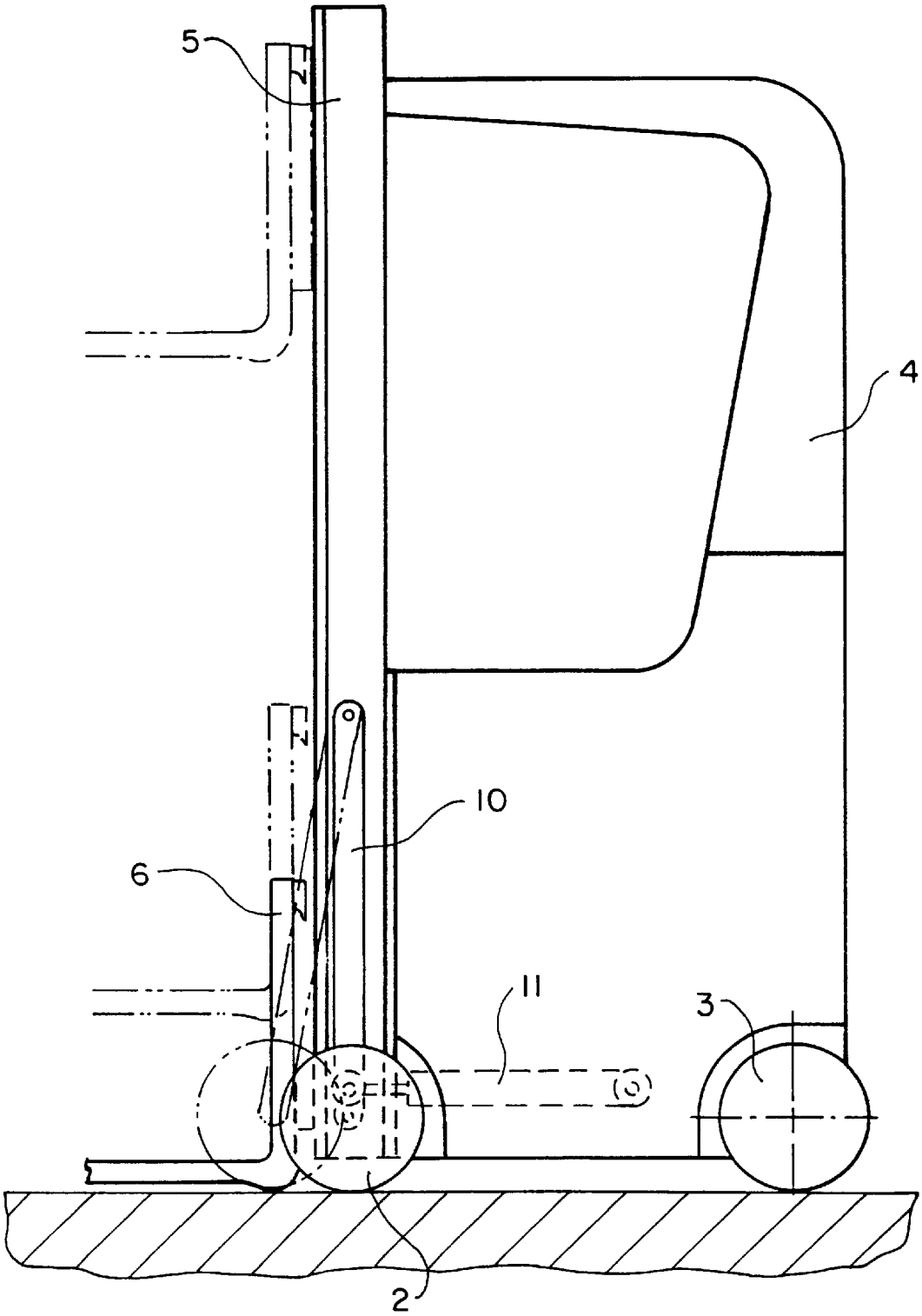
FIG. 3 is a side elevation of an embodiment of a forklift truck according to the invention with a wheel advance mechanism.

In the embodiment of the invention shown in FIG. 3 of the drawings, the stability of the forklift truck is increased by moving the spaced front wheels 2 forwardly toward the load, when the load-carrying device 6 is raised above the top of the wheels 2. This increases the wheelbase and the stability of the truck after the load is lifted. The traction characteristics of the wheels are also improved. When the load-carrying device 6 is in the fully lowered position, the wheels 2 are withdrawn and the truck can still drive directly up to a load.

In the embodiment shown in FIG. 3 of the drawings, there is more space available for the lever 10 and the hydraulic cylinder 11 which produce the advance movement of the wheels 2. The lifting height of the load-carrying device 6 on the lift support structure 5 is thereby not affected, as in the embodiment shown in FIG. 2 of the drawings.

In the embodiment shown in FIG. 3 of the drawings, a manual adjustment by the operator is possible. Thus, when the load-carrying device 6 is moved above the height of the spaced front wheels 2, the wheels 2 are moved forward toward the load in response to a command by the operator. In this case, the mechanism for automatically moving the spaced front wheels 2 is deactivated or disengaged.

Figure 4:
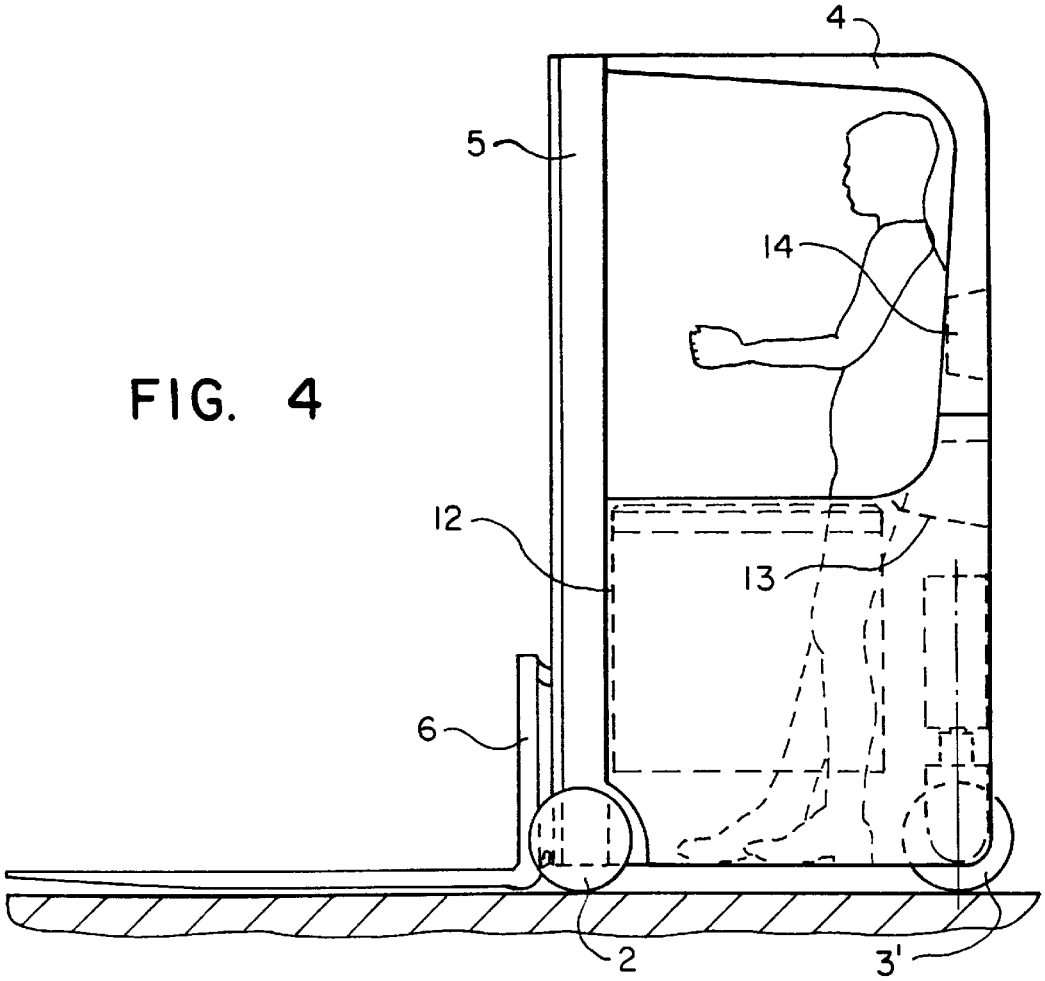
FIG. 4 is a side elevation of a forklift truck according to the invention with the operator in a standing position.
Figure 5:
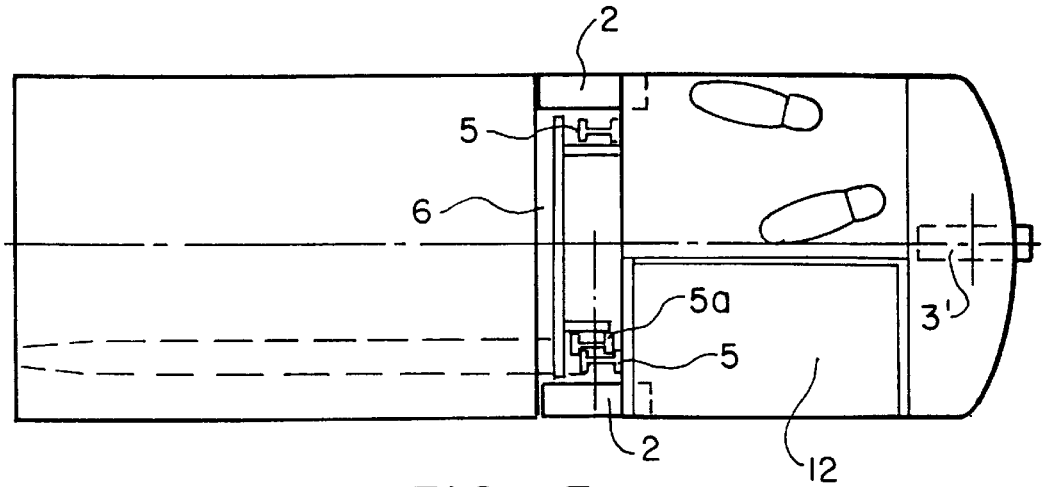
FIG. 5 is a horizontal sectional view of the forklift truck shown in FIG. 4.

FIGS. 4 and 5 of the drawings show a battery powered, electrically operated forklift truck which is designed to be operated with the operator in the standing position. The forklift truck shown in FIGS. 4 and 5 is essentially the same as the forklift truck shown in FIG. 1, except that it is a three-wheel forklift truck. The rear wheel 3' is powered and is steerable by rotation around a vertical axis. The battery compartment 12 is located on the left side of the operator's station in the forward direction of travel.

The forklift truck illustrated in FIG. 1, and particularly the embodiment illustrated in FIGS. 4 and 5, provides a relatively short frame 1 with a length less than about 1.3 meters without the forks of the load-carrying device 6. As shown in FIGS. 4 and 5, the frame 1 only provides sufficient space for a stand-up operator. The lift support structure 5 is positioned near or a little bit behind the front axis of the front wheels 2 as illustrated in FIGS. 4 and 5. As illustrated in FIGS. 4 and 5, the load on the load-carrying device 6 is positioned in front of the front axis of the front wheels 2. The positioning of the load-carrying device 6 and the associated load in front of the front axis distinguishes the type of forklift truck of the present invention from the "Radarmstapler" type trucks in which the load is supported within the wheel base such as shown in U.S. Pat. No. 3,082,894 to Gibson. With the load held in front of the front axis of the front wheels 2 and the frame having a relatively short construction, an independent counterweight is provided for the forklift truck. The weight of the forklift truck also acts as a counterweight to minimize the size of the independent counterweight. The independent counterweight may be positioned, for example, in or adjacent the battery compartment 12, or along the floor of the cab structure of the forklift truck, such that the operator is standing on the independent counterweight or anywhere within the cab roof 4 which extends to the rear end of the forklift truck as illustrated in the figures. The independent counterweight does not extend outside of the cab roof 4. The lift support structure 5 is not displacable back and forth longitudinally of the vehicle as shown in FIGS. 4 and 5 which would otherwise increase the amount of counterweight needed. The interconnected lift support structure 5, cab roof 4 and frame 1 form a stable rigid load-bearing assembly which conducts loads or strains from the middle and top of lift support structure 5 to the rear end of the forklift truck. Essentially, the whole forklift truck is functioning as a frame or a "Fachwerk".

Control levers, not shown, are selectively located in the cab for manual and/or foot operation, and can be folded out of the way to facilitate forward or reverse travel. The operator's station in the cab is equipped with a fold-up seat 13 and a backrest 14. When the operator is standing, the seat 13 is folded up against the backrest 14 to provide a cushion against which the operator can lean.

As shown in FIG. 5 of the drawings, the lift support structure 5 can be a single compound stationary mast as shown in the upper half of the figure or it can have a stationary mast section 5 with an extendable mast section 5*a* located inside the stationary mast section 5, as shown in the lower half of the figure on which the load-carrying device 6 can be vertically moved.

Figure 6:
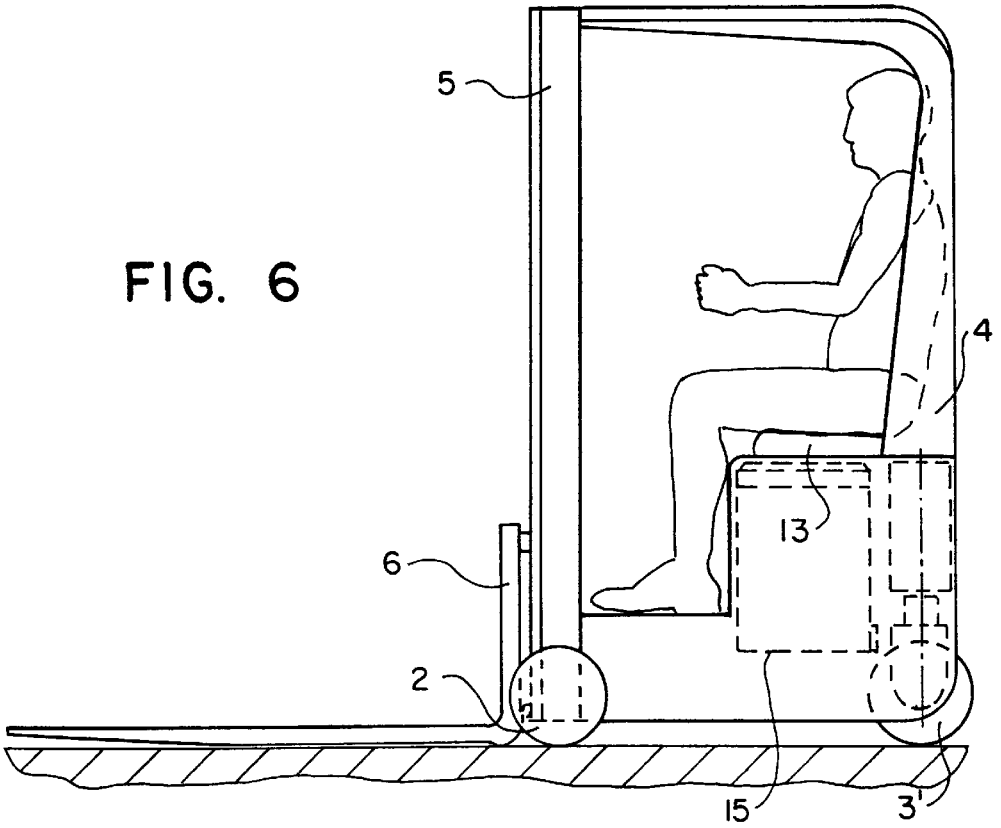
FIG. 6 is a side elevation of a forklift truck according to the invention with the operator in a seated position.
Figure 7:
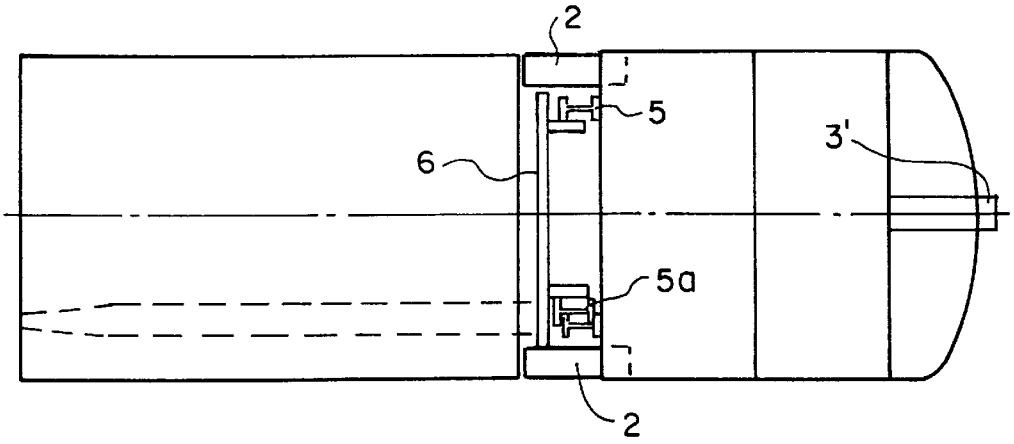
FIG. 7 is a horizontal sectional view of the forklift truck shown in FIG. 6.

FIGS. 6 and 7 of the drawings show a three-wheel forklift truck according to an embodiment of the invention which is designed to be operated by an operator in the seated position. The forklift truck is powered by a battery and is electrically propelled. In this embodiment, the battery compartment 15 is located below the operator's seat 13 in the cab.

While a number of embodiments of the invention have been described in detail herein, it will be understood by those skilled in the art that additional modifications and alternatives to the described embodiments can be developed in light of the overall teachings of the disclosure. Accordingly, the particular embodiments shown in the drawings are illustrative only and are not limiting as to the scope of the invention which is to be given the full breadth of the appended claims and any and all equivalents thereof.

What is claimed is:

1. A forklift truck having:

a frame having a plurality of ground engaging wheels with at least one of said wheels being steerable;

a cab including a roof to protect the driver and a lift support structure connected to said frame wherein at least a portion of said lift support structure is stationary relative to said roof;

load-carrying means mounted on said lift support structure for vertical movement;

means for powering said forklift truck and said load-carrying means;

means for inclining said load-carrying means relative to said lift support structure and said frame, wherein said lift support structure, said roof and said frame are connected to form a load bearing assembly; and wherein said lift support structure, said roof and said frame are substantially rigidly connected.

2. A forklift truck as set forth in claim 1 wherein said lift support structure and said roof are connected to said frame by welds.

3. A forklift truck as set forth in claim 2 wherein said lift support structure has a stationary mast section connected to said roof and said frame, and a vertically extendable mast section located within said stationary mast section and vertically movable relative thereto, whereby the height of said lift support structure is increased by raising said vertically extendable mast section.

4. A forklift truck as set forth in claim 3 wherein said plurality of ground engaging wheels includes spaced front wheels mounted on said frame close to said load-carrying means, and at least one rear wheel mounted on said frame longitudinally spaced from said spaced front wheels, and said lift support structure is located in the longitudinal direction between said spaced front wheels and said at least one rear wheel.

5. A forklift truck as set forth in claim 2 wherein said plurality of ground engaging wheels includes spaced front wheels mounted on said frame close to said load-carrying means, and at least one rear wheel mounted on said frame longitudinally spaced from said spaced front wheels, and said lift support structure is located in the longitudinal direction between said spaced front wheels and said at least one rear wheel.

6. A forklift truck as set forth in claim 5 wherein said at least one rear wheel is driven and steerable.

7. A forklift truck as set forth in claim 2 wherein said plurality of ground engaging wheels includes spaced front wheels mounted on said frame close to said load-carrying means and means for moving said spaced front wheels horizontally toward the load when said load-carrying means is raised above the top of said spaced front wheels.

8. A forklift truck as set forth in claim 1 wherein said lift support structure has a stationary mast section connected to said roof and said frame, and a vertically extendable mast section located within said stationary mast section and vertically movable relative thereto, whereby the height of said lift support structure is increased by raising said vertically extendable mast section.

9. A forklift truck as set forth in claim 8 wherein said plurality of ground engaging wheels includes spaced front wheels mounted on said frame close to said load-carrying means, and at least one rear wheel mounted on said frame longitudinally spaced from said spaced front wheels, and said lift support structure is located in the longitudinal direction between said spaced front wheels and said at least one rear wheel.

10. A forklift truck as set forth in claim 8 wherein said plurality of ground engaging wheels includes spaced front wheels mounted on said frame close to said load-carrying means and means for moving said spaced front wheels horizontally toward the load when said load-carrying means is raised above the top of said spaced front wheels.

11. A forklift truck as set forth in claim 1 wherein said plurality of ground engaging wheels includes spaced front wheels mounted on said frame close to said load-carrying means and means for moving said spaced front wheels horizontally toward the load when said load-carrying means is raised above the top of said spaced front wheels.

12. A forklift truck as set forth in claim 1 wherein said cab has a floor and a battery for electrically powering said forklift truck, an operator's station in said cab wherein an operator operates said forklift truck in a standing position on said floor, and said battery is located on said floor next to said operator's station.

13. A forklift truck as set forth in claim 1 including a battery for electrically powering said forklift truck, an operator's station in said cab, and a seat in said cab wherein an operator operates said forklift truck in a sitting position on said seat, and said battery is located below said seat.

14. A forklift truck including:

a frame having a plurality of ground engaging wheels with at least one of said wheels being steerable;

a cab including a roof to protect the driver and a lift support structure connected to said frame, wherein said lift support structure, said roof and said frame are substantially rigidly connected to form a load-bearing assembly;

load-carrying means mounted on said lift support structure for vertical movement;

means for powering said forklift truck and said load-carrying means;

said plurality of ground engaging wheels including spaced front wheels mounted on said frame close to said load-carrying means; and said plurality of ground engaging wheels further including at least one rear wheel mounted on said frame longitudinally spaced from said spaced front wheels, wherein said lift support structure includes a vertically extending mast with a forward edge of said vertically extending mast located in the longitudinal direction between a vertical plane connecting a forward edge of said spaced front wheels and a vertical plane connecting a rearward edge of said spaced front wheels.

15. A forklift truck as set forth in claim 14, including means for moving said load-carrying means horizontally in front of said spaced front wheels when said load-carrying device is in the lowest position.

16. A forklift truck as set forth in claim 14 wherein said at least one rear wheel is driven and steerable.

17. A forklift truck including:

a frame having a plurality of ground engaging wheels with at least one of said wheels being steerable;

a cab including a roof to protect the driver and a lift support structure connected to said frame, wherein said lift support structure, said roof and said frame are connected substantially rigidly to form a load-bearing assembly;

load-carrying means mounted on said lift support structure for vertical movement;

means for powering said forklift truck and said load-carrying means;

said plurality of ground engaging wheels including spaced front wheels mounted on said frame close to said load-carrying means; and means for moving said spaced front wheels horizontally to a forwardmost position toward the load when said load-carrying means is raised above the top of said spaced front wheels, wherein said forwardmost position positions a rearward edge of said spaced front wheels longitudinally behind a forward edge of said lift support structure.

18. A forklift truck comprising:

a short frame defining an operator station with a floor defining a space for a standing operator wherein said frame has a plurality of ground engaging wheels with at least one of said wheels being steerable;

at least one of said wheels defines a front axis of said forklift truck;

a lift support structure connected to said frame near said front axis, said lift support structure not displaceable longitudinally relative to said frame;

a load-carrying device mounted on said lift support structure for vertical movement, wherein a load supported on said load-carrying device is positioned in front of said front axis;

means for powering said forklift truck and said load-carrying means; and a cab including a roof connected to said lift support structure and said frame, said cab covering said space for a standing operator and wherein said cab, said lift support structure and said frame are substantially rigidly connected to form a stable, rigid load bearing assembly conducting loads from the middle and top of said lift support structure to a rear end of said forklift truck.

19. A forklift truck as set forth in claim 18 wherein said frame has a longitudinal length of less than 1.3 meters.

20. A forklift truck as set forth in claim 18 further including an independent counterweight mounted within said cab, wherein said counterweight does not extend outside of said roof of said cab.

21. A forklift truck as set forth in claim 20 wherein said plurality of ground engaging wheels includes a pair of front wheels mounted on said frame at said axes and at least one driven, steerable rear wheel is mounted on said frame longitudinally spaced from said spaced front wheels, wherein said lift support structure is located between said spaced front wheels and said at least one rear wheel in said longitudinal direction of said forklift truck, wherein said lift support structure and said roof are connected to said frame by welds, wherein said cab has a floor and a battery for electrically powering said forklift truck, and wherein said battery is located on said floor next to said operators station.

* * * * *